US006220663B1

(12) United States Patent
Benden et al.

(10) Patent No.: US 6,220,663 B1
(45) Date of Patent: Apr. 24, 2001

(54) PUMP ASSEMBLY FOR A CHAIR

(75) Inventors: Mark E. Benden; Rebecca C. Boenigk, both of College Station; Kendall A. Belt; David W. Ebner, both of Bryan, all of TX (US)

(73) Assignee: Neutral Posture Ergonomics, Inc., Bryan, TX (US)

( * ) Notice: Subject to any disclaimer, the term of this patent is extended or adjusted under 35 U.S.C. 154(b) by 0 days.

(21) Appl. No.: 09/290,141

(22) Filed: Apr. 13, 1999

(51) Int. Cl.[7] ..... A47C 7/46; B60N 2/22

(52) U.S. Cl. ..... 297/284.6

(58) Field of Search ..... 297/284.4, 284.6, 297/452.41

(56) References Cited

U.S. PATENT DOCUMENTS

| | | | | |
|---|---|---|---|---|
| 4,514,010 | * | 4/1985 | Gonzalez | 297/284.6 |
| 4,518,200 | | 5/1985 | Armstrong | 297/284 |
| 4,807,931 | * | 2/1989 | Ishida et al. | 297/284.6 |
| 4,938,528 | | 7/1990 | Scott | 297/284 |
| 5,562,324 | * | 10/1996 | Massara et al. | 297/284.6 |
| 5,660,438 | | 8/1997 | Tedesco | 297/284 |
| 5,711,575 | * | 1/1998 | Hand et al. | 297/284.6 |
| 5,758,925 | | 6/1998 | Schrewe et al. | 297/284 |

FOREIGN PATENT DOCUMENTS

| | | | | |
|---|---|---|---|---|
| 3115269 | * | 10/1982 | (DE) | 297/284.6 |

OTHER PUBLICATIONS

Owner's Manual, Neutral Posture Ergonomics, Inc., Black & White Brochure, Feb., 1997.
Setting the Ergonomic Standard, Color Brochure, Netrual Posture Ergonomics, Inc., Apr. 1997.

* cited by examiner

*Primary Examiner*—Peter R. Brown
(74) *Attorney, Agent, or Firm*—Howrey Simon Arnold & White, LLP

(57) ABSTRACT

A pump assembly is described for use in the field of workstation design. The pump assembly is described for use in combination with a chair back having an expandable fluid bladder for lumbar support. The pump assembly allows a person, while seated, to more easily inflate or deflate an expandable fluid bladder. An actuator for inflating and deflating the expandable fluid bladder is also described.

9 Claims, 11 Drawing Sheets

PUMP ASSEMBLY FOR A CHAIR

BACKGROUND OF THE INVENTION

1. Field of the Invention

The invention relates to a chair. More particularly, this invention relates to a pump assembly for use with a chair having a chair back equipped with an expandable fluid bladder for lumbar support.

2. Description of the Related Art

In the workplace, persons such as machine operators and secretaries are often required to perform tasks in a sedentary position. Without proper support of the back, the person can become fatigued and possibly subjected to back strain. It is now known that utilizing ergonomic principles in chair design can increase a worker's productivity, reduce back fatigue, and reduce the likelihood of the incidences of back strain.

One area in which this proper support is especially necessary is the support of the lumbar or lower region of a seated person's back. It is known in the chair design industry that it is possible to provide a solid cushion in the lumbar region of the back of the chair for back support. Typically, these cushions are made of foam material. However, it has been found that such a foam cushion proves uncomfortable to the user over time.

It is also known in the chair design industry to provide lumbar support into the back of a chair in another way: by using an expandable fluid bladder. Expandable fluid bladders have proven to be more comfortable than foam cushions. One type of expandable fluid bladder—an air bladder—is described, for example, in U.S. Pat. No. 5,758,925 to Schrewe, et al. and in U.S. Pat. No. 4,518,200 to Armstrong.

Recently, chairs have been designed incorporating these expandable fluid bladders directly into the back of chairs. Pump means in the form of rubber bulb pumps have been incorporated into chair backs to inflate the expandable fluid bladders. Some of these chair backs have the pump means hidden behind a foam cushion; some of these chair backs have a rubber bulb pump protruding from the back of the chair back. In either event, a person sitting the in the chair cannot easily inflate the lumbar support while seated in these chairs. This is problematic since a person should be seated to properly determine whether the inflation level of the expandable fluid bladder is adequate to support the back. With these chairs the person must get out of the chair, then inflate the expandable fluid bladder, and then return to the seat to test the lumbar support. Accordingly, these prior chairs are inconvenient because much time is wasted in adjusting the lumbar support.

It is also known in the chair design industry that expandable fluid bladders must be deflatable as well as inflatable in order to be practical. To that end, conventional chair backs with air bladders are provided with a fluid release or button located somewhere on the chair. By depressing this fluid release or button, the air bladder is deflated.

However, in these prior chairs, one tool is used to inflate the expandable fluid bladder and a different mechanism is used to deflate the expandable fluid bladder. For instance, the rubber bulb pump may be used to inflate the air bladder, while the fluid release or button is used to deflate the air bladder. Because at least two different mechanisms are manipulated to adjust the air bladder, a user cannot conveniently adjust the air bladder from a seated position to attain proper lumbar support.

Portable cushions with air bladders for lumbar support are also well-known as discussed in U.S. Pat. No. 4,518,200 to Armstrong. However, these portable supports are not practical for use in the modem workplace where durable furniture is preferred.

For the foregoing reasons, there is a need for a pump assembly that can overcome, or at least minimize, one or more problems set forth above.

SUMMARY OF THE INVENTION

In some aspects, the present invention relates to an apparatus and a method to inflate and deflate an expandable fluid bladder. In these aspects, the present invention (1) allows the user to use the same actuator to both inflate and deflate a lumber support, and (2) allows the user to remain seated while adjusting the lumber support. Thus, a person can conveniently adjust the amount of support provided by the lumbar support without getting out of the chair. Further, in the present invention, the convenience to the user is enhanced because she does not have to be familiar with the location of two different actuators to adjust the lumbar support.

According to one aspect of the invention, a pump assembly for use in combination with a chair back having an expandable fluid bladder for lumbar support, said expandable fluid bladder being inflatable and deflatable by a person seated in a chair which includes as one component said chair back, is comprised of pump means for transferring fluid into the expandable fluid bladder, said expandable fluid bladder being located in the chair back, an actuator adapted to engage the pump means to transfer fluid into said expandable fluid bladder, and valve means functionally adapted to release fluid from said expandable fluid bladder based on contact with said actuator. In some embodiments, the pump assembly further comprises tubing, and the valve means further comprises a first end, a second end, and a fluid release, the first end of the valve means connected to the pump means, the second end of the valve means connected to the expandable fluid bladder by the tubing, and the actuator contacting the fluid release to release fluid from said expandable fluid bladder.

In some embodiments, the pump assembly further comprises a biasing means connected to the actuator, the biasing means adapted to resist the actuator's contact with the fluid release. In some embodiments, the biasing means further comprises a clip, a first post connected to the chair back, a second post connected to the chair back, and a third post located on the actuator, the clip being associated with each post. In some aspects, the pump assembly further comprises a buffer pivotally mounted on the chair back between the pump means and the actuator. In some embodiments, a contact is adapted to movably secure the buffer onto the chair back.

In some embodiments, a wall is mounted on the chair back and positioned adjacent to the pump means. In some embodiments, a valve means cover is connected to the chair back by a screw, the valve means being positioned between the valve means cover and the chair back. In some embodiments, the fluid is air.

In some aspects, a pump assembly is provided for use in combination with a chair back having an air bladder for lumbar support, said air bladder being inflatable and deflatable by a person seated in a chair which includes as one component said chair back, comprising pump means for transferring air into the air bladder, said air bladder being located in the chair back, an actuator adapted to engage the pump means to transfer air into said air bladder, and valve means functionally adapted to release air from said air bladder based on contact with said actuator, tubing, the valve means further comprising a first end, a second end, and a fluid release, the first end of the valve means connected to the pump means, the second end of the valve means connected to the air bladder by tubing, the actuator contacting the fluid release to release fluid from said air bladder, a buffer pivotally mounted on the chair back between the pump means and the actuator, a contact adapted to movably secure the buffer onto the chair back, a wall mounted on the chair back, the wall adjacent to the pump means, a biasing means connected to the actuator adapted to resist the actuator contacting the valve means, the biasing means further comprising a clip, a first post connected to the chair back, a second post connected to the chair back, and a third post located on the actuator, the clip associated with each post, and a valve means cover connected to the chair back by a screw, the valve means being positioned between the valve cover and the chair back.

In some aspects, a pump assembly for use with a chair back having an expandable fluid bladder is provided, the expandable fluid bladder being inflatable and deflatable by a person seated in a chair comprising a pump, a valve having a fluid release, means pivotally attached to the chair back for engaging the pump to inflate the expandable fluid bladder, and means for contacting the fluid release on the valve to deflate the air bladder.

In some embodiments the pump assembly further comprises tubing, the valve further comprising a first end and a second end, the first end of the valve connected to the pump, and the tubing connecting the second end of the valve to the expandable fluid bladder. In some embodiments, the pump assembly further comprises a buffer pivotally mounted on the chair back between pump and the means for engaging the pump.

In some embodiments, the pump assembly further comprises a contact adapted to movably secure the buffer onto the chair back. In some embodiments the pump assembly comprises a wall mounted on the chair back adjacent to one side of the pump.

In some embodiments, a biasing means is connected to the actuator adapted to resist the actuator contacting the fluid release. In some embodiments, the biasing means further comprises a clip, a first post connected to the chair back, a second post connected to the chair back, and a third post located on the actuator, the clip associated with each post. In some embodiments, the lumbar pump assembly comprises a valve cover connected to the chair back by a screw, the valve being positioned between the valve cover and chair back.

In some aspects, a method of supporting the back of a seated person in a chair having a chair back with an expandable fluid bladder located in the chair back is comprised of providing a chair back, providing an expandable fluid bladder, said expandable fluid bladder being located in the chair back, providing a pump means, providing a actuator pivotally mounted on the chair back, and engaging the actuator to contact the pump means to inflate the expandable fluid bladder.

A method of supporting the back of a person seated in a chair is disclosed which includes providing a chair back having an expandable fluid bladder, providing a pump means, providing a actuator pivotally mounted on the chair back, providing a valve means having a fluid release, and engaging the actuator to contact the fluid release on the valve means to deflate the expandable fluid bladder.

A method of supporting the back of a person seated in a chair is also disclosed including providing a chair back, providing an expandable fluid bladder, said expandable fluid bladder located in said chair back, providing a pump assembly comprising pump means for transferring fluid into the expandable fluid bladder, said expandable fluid bladder being located in the chair back, an actuator adapted to engage the pump means to transfer fluid into said expandable fluid bladder, and valve means functionally adapted to release fluid from said expandable fluid bladder based on contact with said actuator, and engaging the actuator to regulate the amount of fluid in the expandable fluid bladder.

Figure 4A:
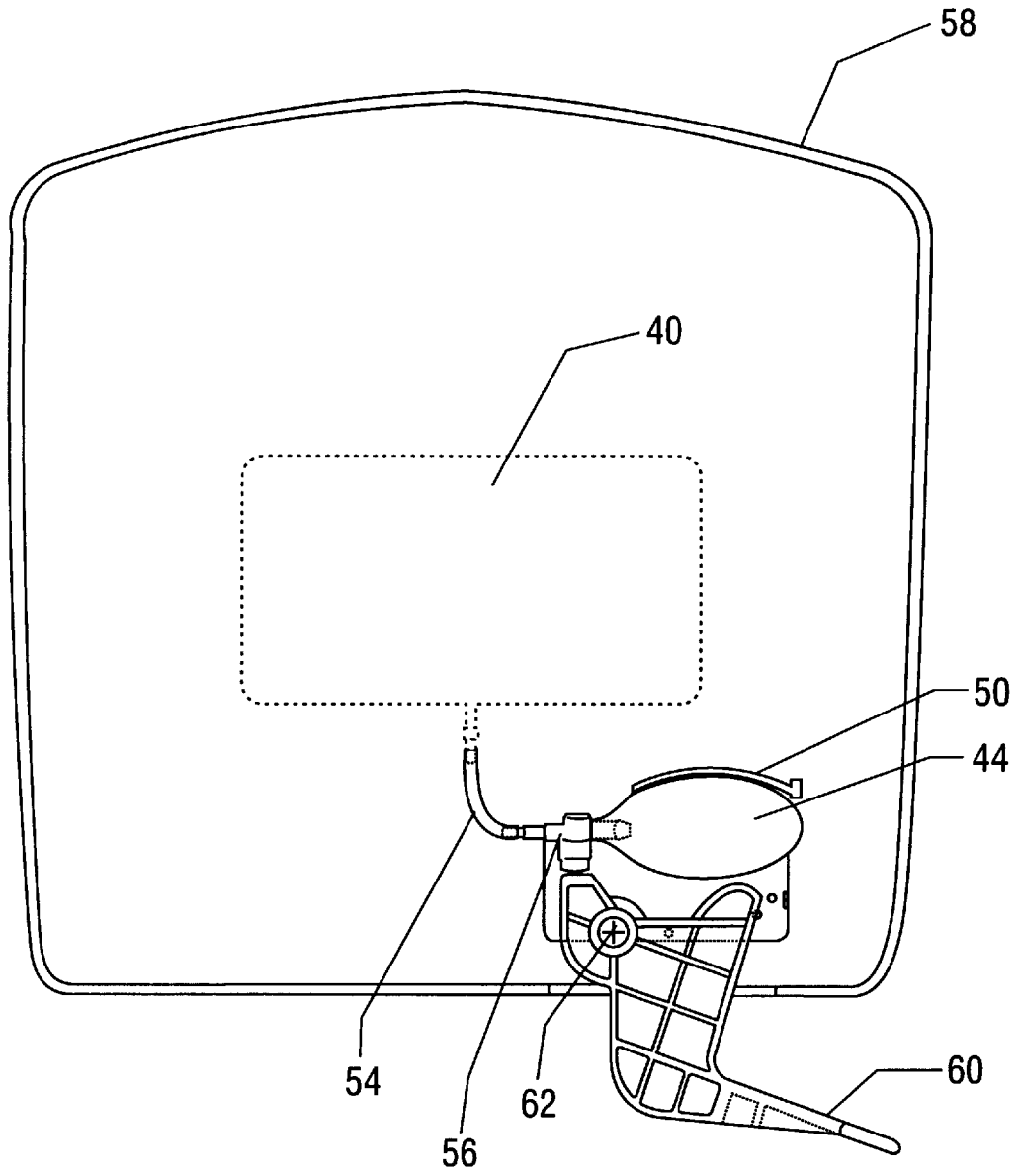
FIG. 4A shows the rear view of an embodiment of the invention.

FIG: 4B shows the side view of the embodiment shown in FIG. 4A.

Figure 5:
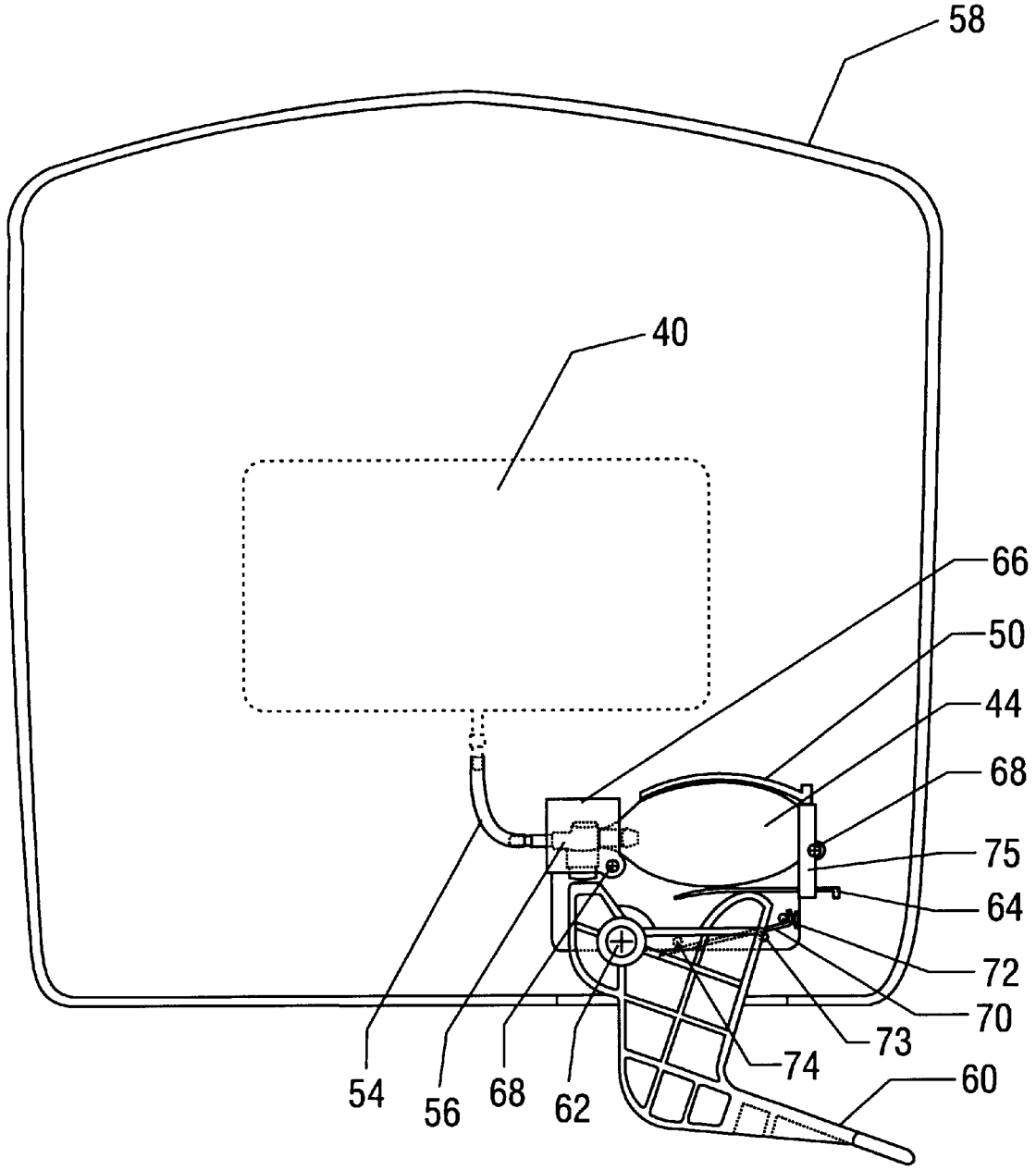

FIG. 5 a rear view of an embodiment of the invention.

Figure 6A:
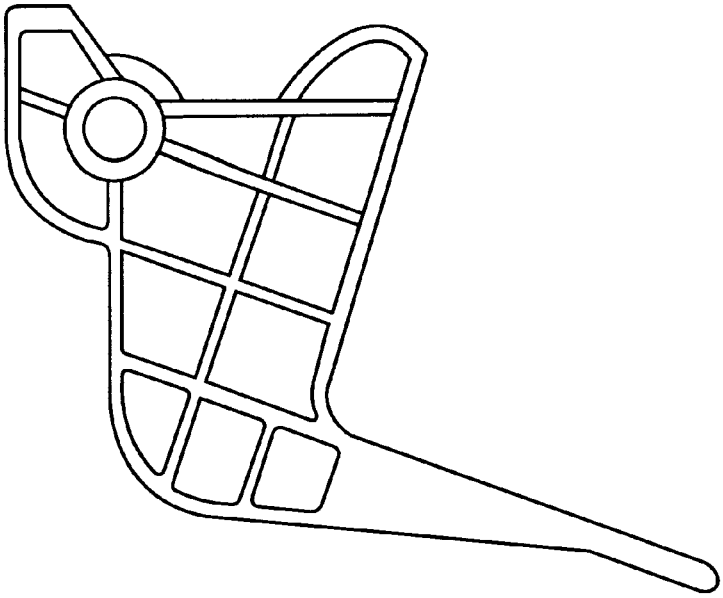

FIG. 6A shows a side view of the actuator of one embodiment.

Figure 6B:
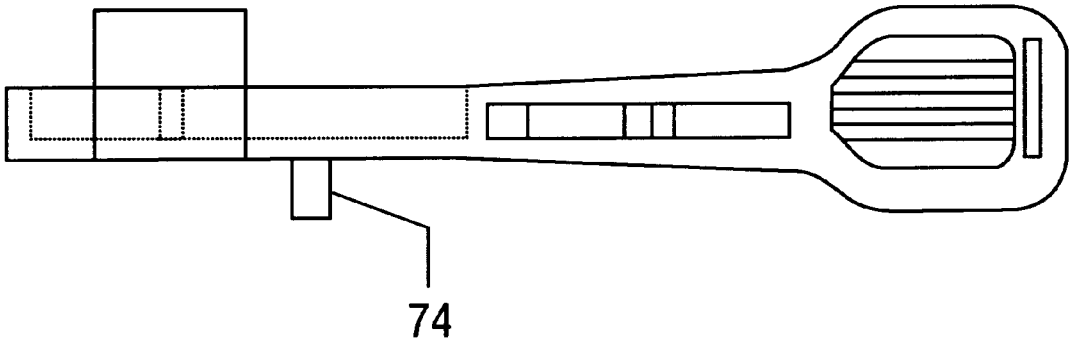

FIG. 6B shows a top view of the actuator of FIG. 6A.

Figure 7:
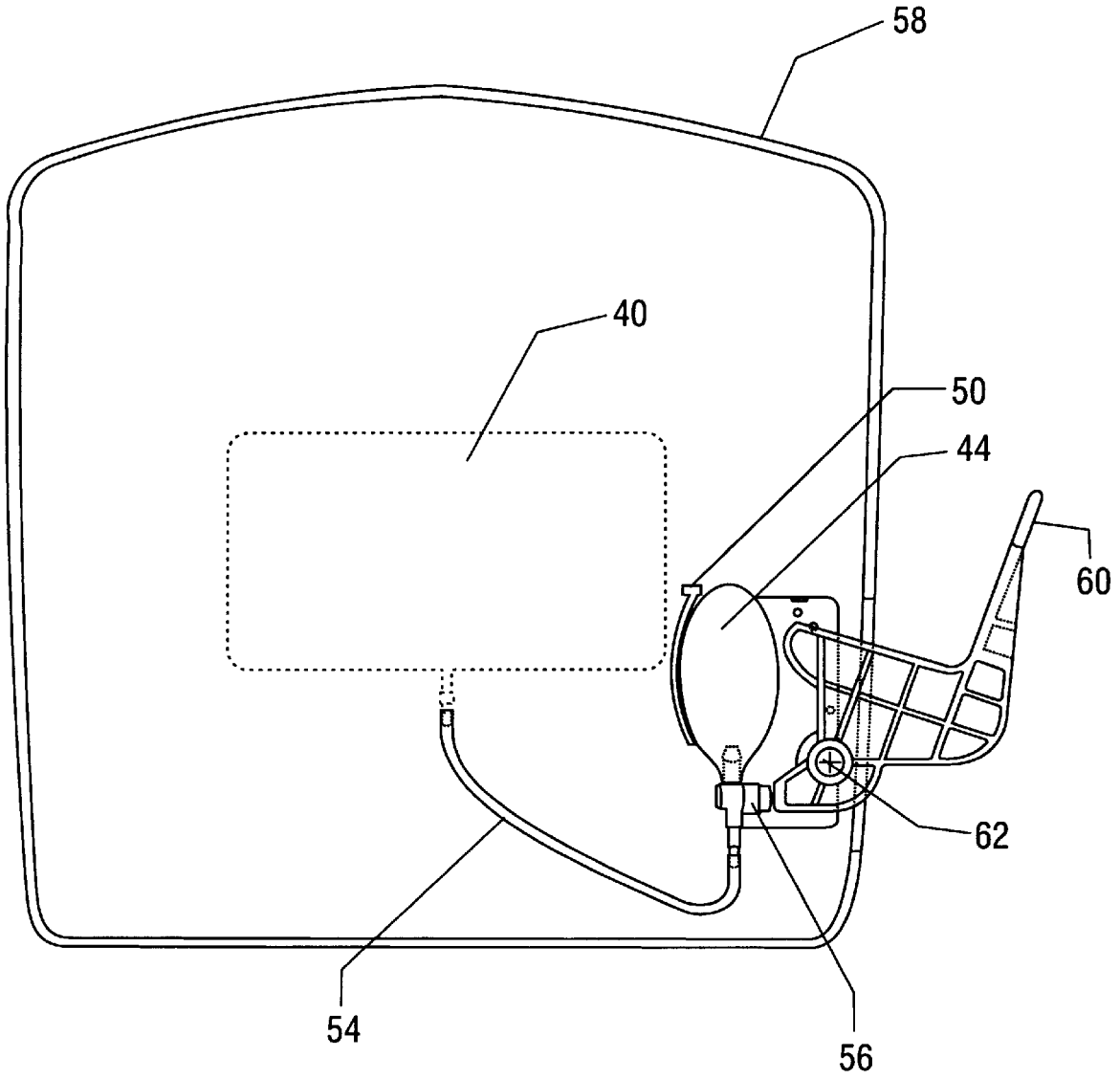

FIG. 7 shows another embodiment of the invention.

Figure 8:
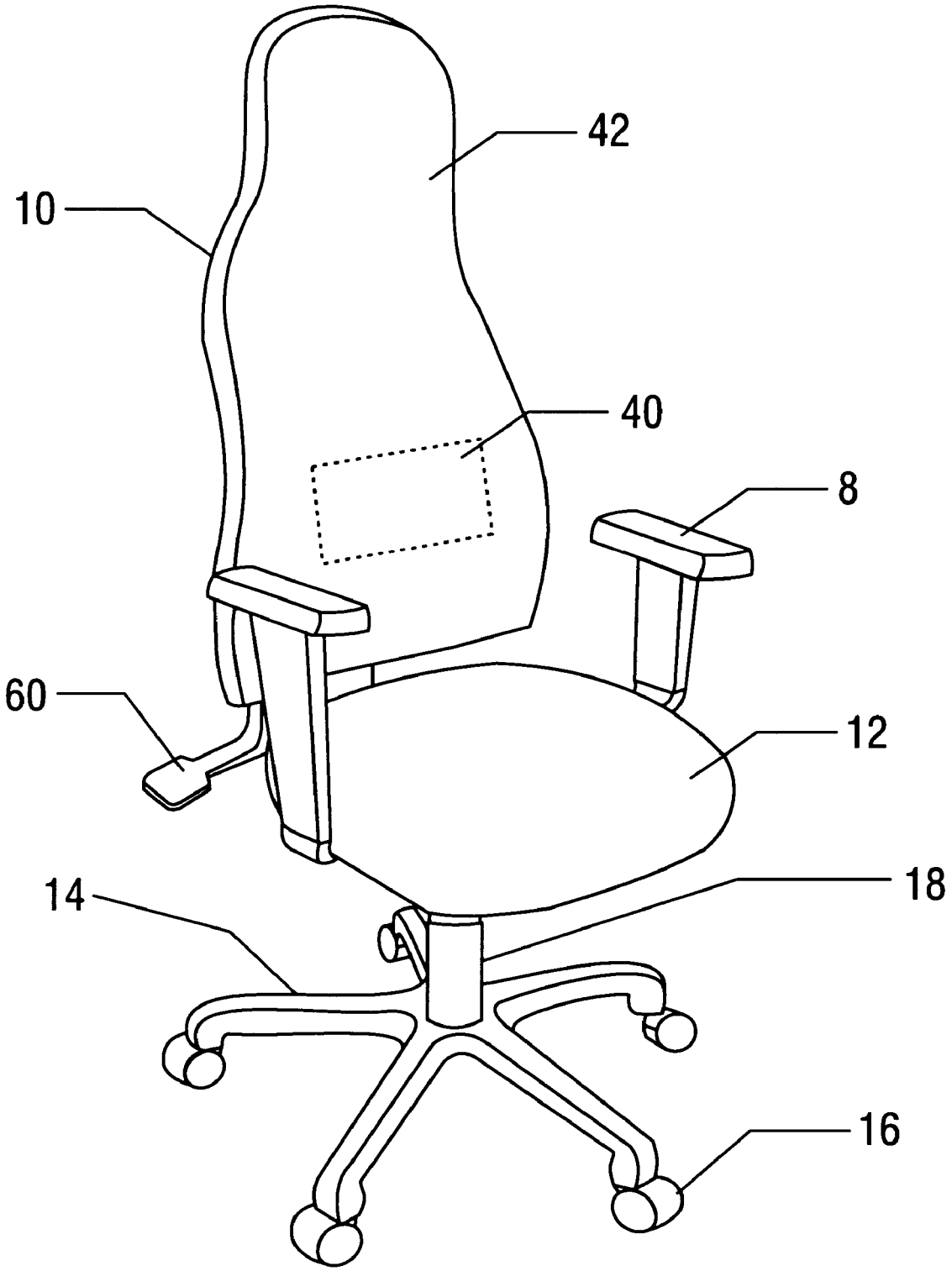

FIG. 8 shows a chair with an embodiment attached thereto.

DESCRIPTION OF ILLUSTRATIVE EMBODIMENTS

Embodiments of the invention will now be described with reference to the accompanying figures.

The invention relates to an assembly and a method to inflate an expandable fluid bladder. In some embodiments, the pump assembly may be utilized to inflate an expandable fluid bladder installed on a chair back to support the lumbar portion of a seated person's back. In some embodiments, the pump assembly may be conveniently used by a seated person to adjust the expandable fluid bladder to provide proper lumbar support. Thus, a person can conveniently adjust the amount of support provided without getting out of the chair.

In some embodiments, the same mechanism used to inflate the expandable fluid bladder is used to deflate the expandable fluid bladder. Thus, the convenience for the user is enhanced since she will not have to be familiar with the location and operation of two actuators. In some embodiments, the mechanism used to inflate the expandable fluid bladder is more aesthetically pleasing than the conventional exposed bulb pump.

Further aspects and advantages of the various embodiments of the invention will become apparent from consideration of the following description and drawings.

Figure 1:
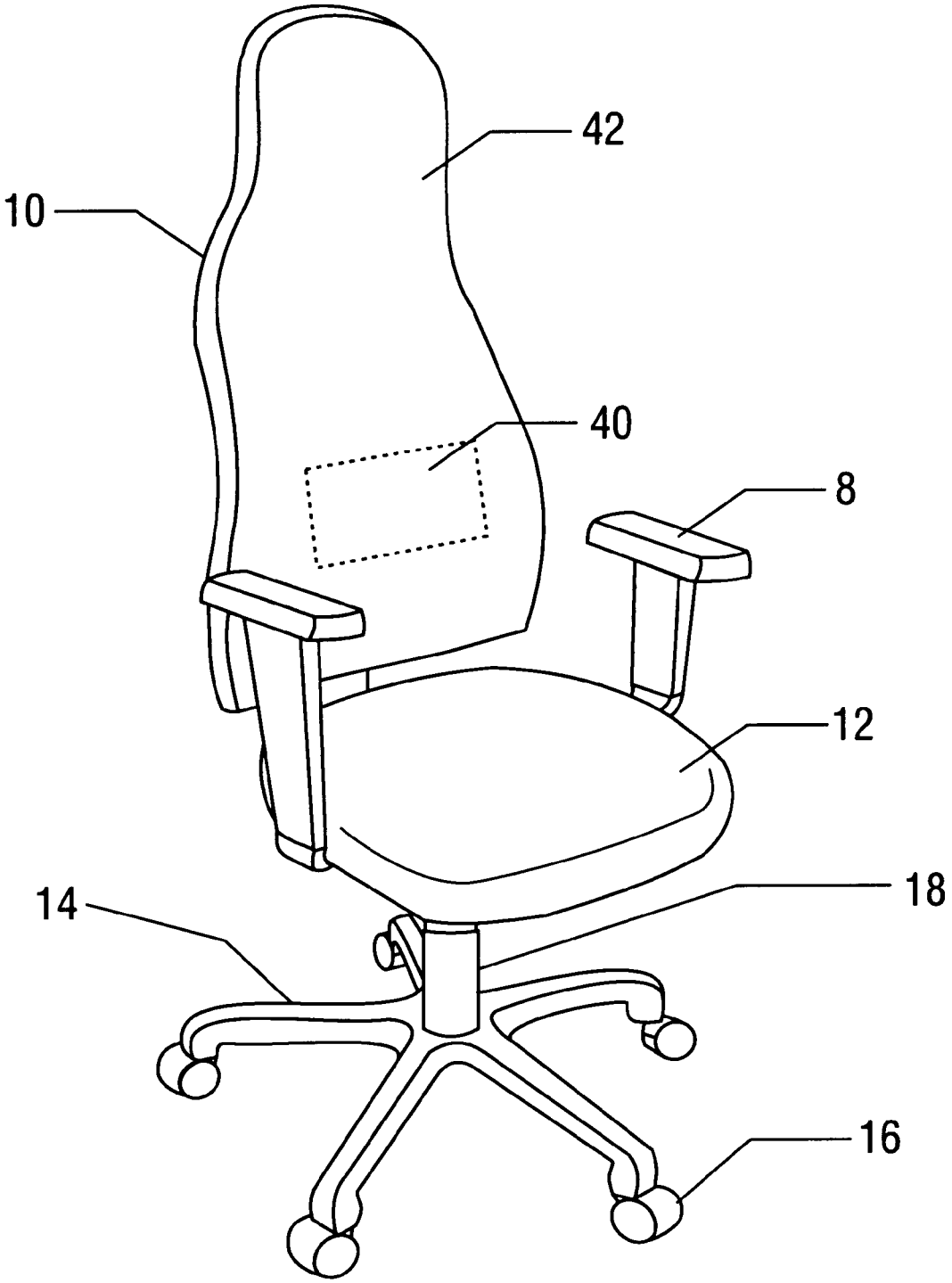
FIG. 1 (Prior Art)
FIG. 1 shows a prior art chair industrial chair.

Referring to FIG. 1, a prior art industrial chair is shown to be made up for a chair back 10, a chair arm 8, a seat 12, resting on a support column 18, supported by chair legs 14, an expandable fluid bladder 40, and chair rollers 16. Chair legs 14 are substantially horizontally extending legs. In operation a person (not pictured) sits in seat 12. The lumbar portion of the person's back rests near expandable fluid bladder 40. Expandable fluid bladder 40 may be inflated or deflated depending upon the amount of lumbar support a particular user desires.

Figure 2A:
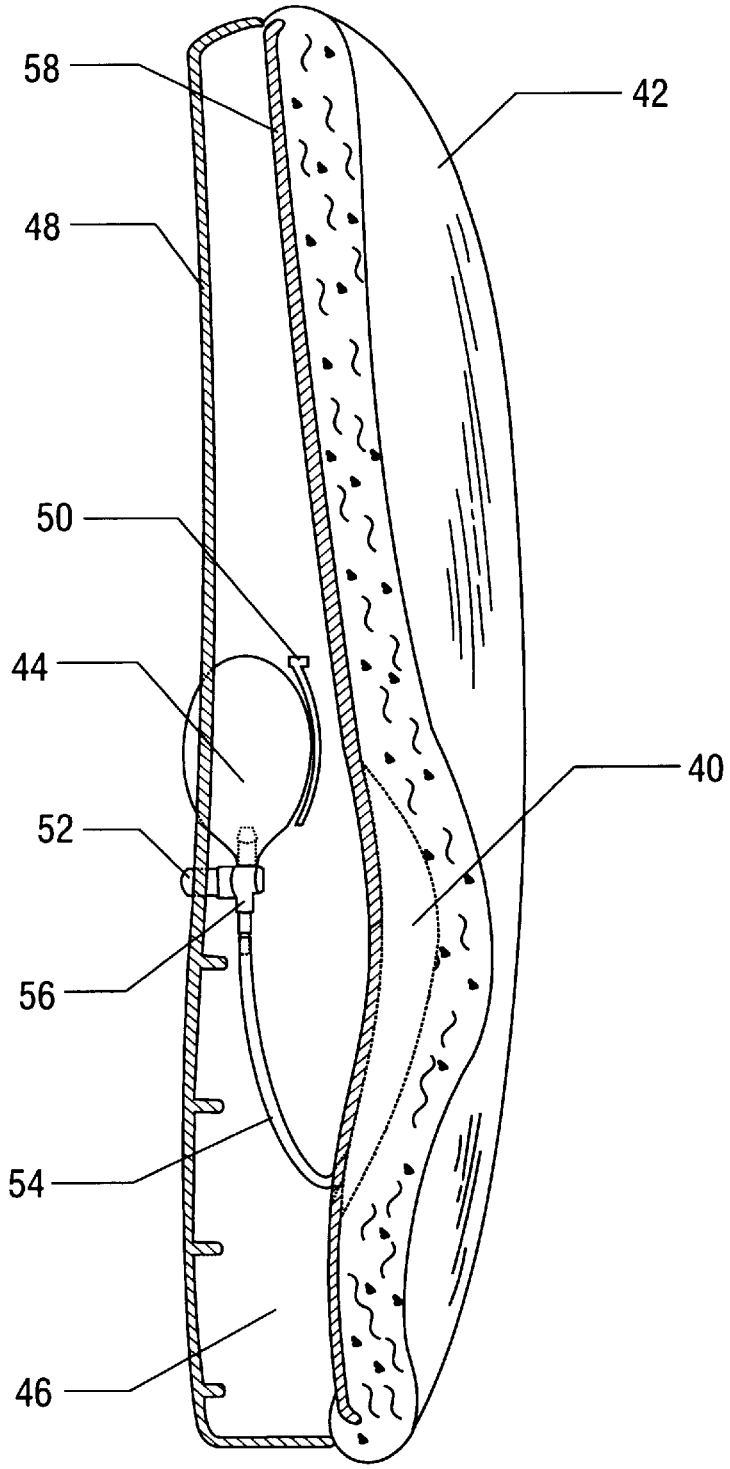
FIG. 2A (Prior Art)
FIG. 2A shows the side view of the chair back of a prior art chair providing lumbar support with an air bladder.
Figure 2B:
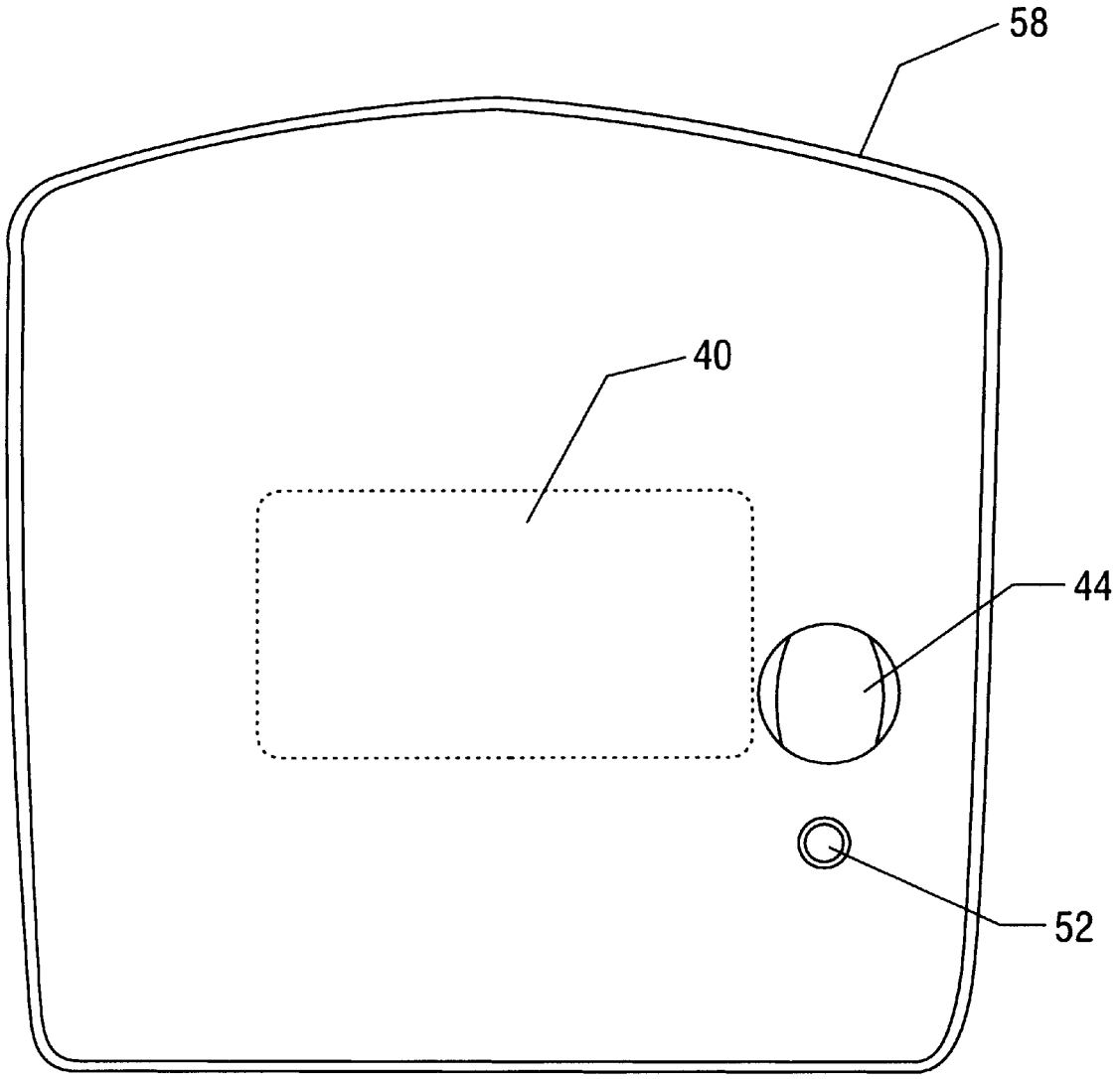
FIG. 2B (Prior Art)
FIG. 2B shows a rear view of the back of prior art chair of FIG. 2A.

Referring to FIGS. 2A–2B, a prior art chair back is shown. Expandable fluid bladder 40 is located at the lumbar portion of cushion 42. Front plate 58 is connected to back plate 48 thus making a cavity 46 between the two plates. Within the cavity is tubing 54 which connects expandable fluid bladder 40 to valve means 56. In this particular version, the fluid in the expandable fluid bladder 40 is air. Valve means 56 is provided with fluid release, or button, 52. Valve means 56 is also connected to tubing 54 which is connected to pump means 44. As shown, the pump means constitutes a rubber bulb pump. Wall 50 is connected to back plate 48. Back plate 48 possesses two holes: one for pump means 44 and one for fluid release 52.

In operation a person (not shown) rests her back against cushion 42. To provide support for her lumbar region, expandable fluid bladder 40 may be inflated or deflated. To increase the amount of lumbar support, the expandable fluid bladder is inflated. To inflate expandable fluid bladder 40, the user places her hand on pump means 44. By depressing pump means 44, pump means 44 is compressed against the wall 50. Compression of pump means 44 forces air through tubing 54, through valve means 56, through tubing 54, and into expandable bladder 40. If the expandable bladder 40 becomes too inflated, it may be deflated by depressing fluid release 52. The user accesses both fluid release 52 and pump means 44 through the back of the chair. Thus, to actuate either pump means 44 or fluid release 52, the user cannot be seated in the chair and easily reach the back of the chair.

Figure 3A:
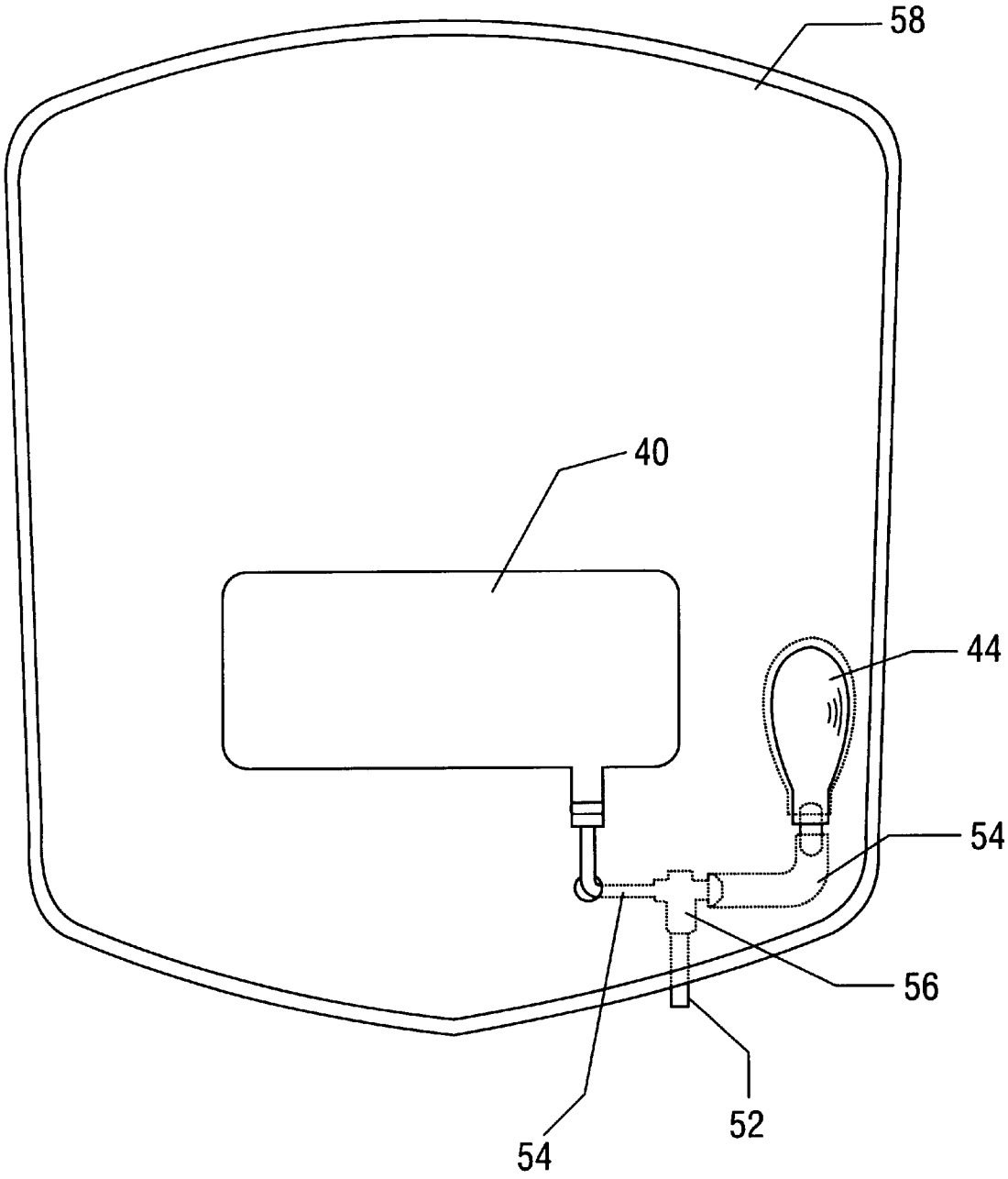
FIG. 3A (Prior Art)
FIG. 3A shows a front view of a prior art chair.
Figure 3B:
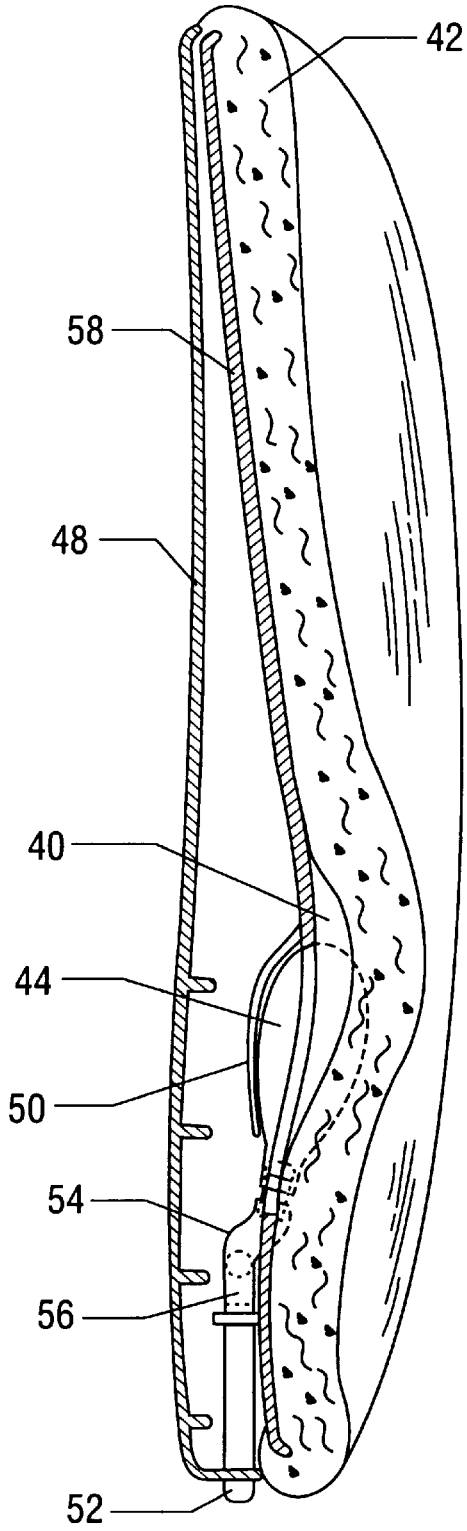
FIG. 3B (Prior Art)
FIG. 3B shows a side view of a prior art chair.

Referring to FIGS. 3A and 3B, another prior art chair back is shown. FIG. 3A shows a front view of this prior art chair back. Expandable fluid bladder 40 is located at the lumbar section of front plate 58. Tubing 54 connects expandable fluid bladder 40 to valve means 56. Tubing 54 also connects 56 to pump means 44. Fluid release 52 is also connected to valve means 56. Referring to FIG. 3B, back plate 48 is connected to front plate 58. Expandable fluid bladder 40 is located on the outside of front plate 58 and is then covered by cushion 42. In operation, to inflate expandable fluid bladder 40, the user places her hand over pump means 44 which is covered by cushion 42. By depressing cushion 42 in a location over pump means 44, pump means 44 is compressed against wall 50. Fluid, such as air, is thus passed through pump means 44, through valve means 56, through tubing 54, and finally into expandable fluid bladder 40. To deflate expandable fluid bladder 40, the user may depress fluid release 52 which releases fluid through valve means 56 and through tubing 54. Again because of the placement of the pump means 44 and fluid release 52, a user cannot easily adjust pressure in the expandable fluid bladder 40 from a seated position.

Turning to FIG. 4A, one embodiment of the present invention is shown. FIG. 4A shows a rear view of one embodiment of the present invention. Front plate 58 is shown and back plate 48 is removed thus exposing the internal workings of this embodiment. The chair back is comprised of front plate 58 connected to back plate 48 thus creating a cavity 46. Actuator 60 is pivotally mounted to the chair back via pin 62. Actuator 60 can rotate about pin 62. By pulling the lever on actuator 62 upward, pump means 44 is compressed against wall 50. By pushing actuator 60 downward, fluid release 52 is depressed.

The pump means 44 shown is a rubber bulb pump. However, any type of pump assembly could be utilized such as a motorized pump, a foot pump, any type of hand pump. Further, the fluid used in the expandable fluid bladder is typically air. However, any fluid would suffice such as water, oil, or other gaseous materials.

The expandable fluid bladder may be inflated and deflated as follows with one actuator. To inflate expandable fluid bladder 40, actuator 60 is rotated counter clockwise to compress pump means 44. Pump means 44, a rubber bulb pump, is directly connected to valve means 56 which is connected to tubing 54, which is connected to expandable fluid bladder 40 which is an air bladder in this embodiment. In this fashion, compressed fluid—air in this embodiment—passing from pump means 44—here a rubber bulb pump—inflates expandable fluid bladder 40—here, an air bladder. Because actuator 60 is located at the base of the chair back, a user can be seated in the chair while inflating expandable fluid bladder 40 with actuator 60.

Thus, the expandable fluid bladder may be inflated and deflated with a single actuator in these embodiments. This overcomes the problems associated with the inconvenience and difficulty of using two actuators in the prior art. Further, having one actuator to perform two tasks reduces the number of component parts required to perform the same function, which may lead to simplified construction, decreased production costs, and less required maintenance.

Similarly, the user may be seated while deflating expandable fluid bladder 40 again using actuator 60. To deflate expandable fluid bladder 40, the user places a downward force on actuator 60 which pivots clockwise around pivot pin 62. Actuator 60 then, by rotating clockwise, contacts fluid release 52 which releases fluid through the valve means 56, through tubing 54 from expandable fluid bladder 40. In this embodiment, the fluid is preferably air but could be air, water, oil, or any other suitable material. Further, as shown, the pump means is preferably a rubber bulb pump although any type of pump would suffice such as an electric pump, a foot pump, or any type of hand pump.

Because the user may be seated while inflating or deflating the bladder, the lumbar support is more easily set to the desired level. A person may be seated while using these embodiments, she no longer has to get out of the chair, inflate the expandable fluid bladder, and then return to the seat to try out the lumber support. Thus, with these embodiments, convenience to the user is increased.

Figure 4B:
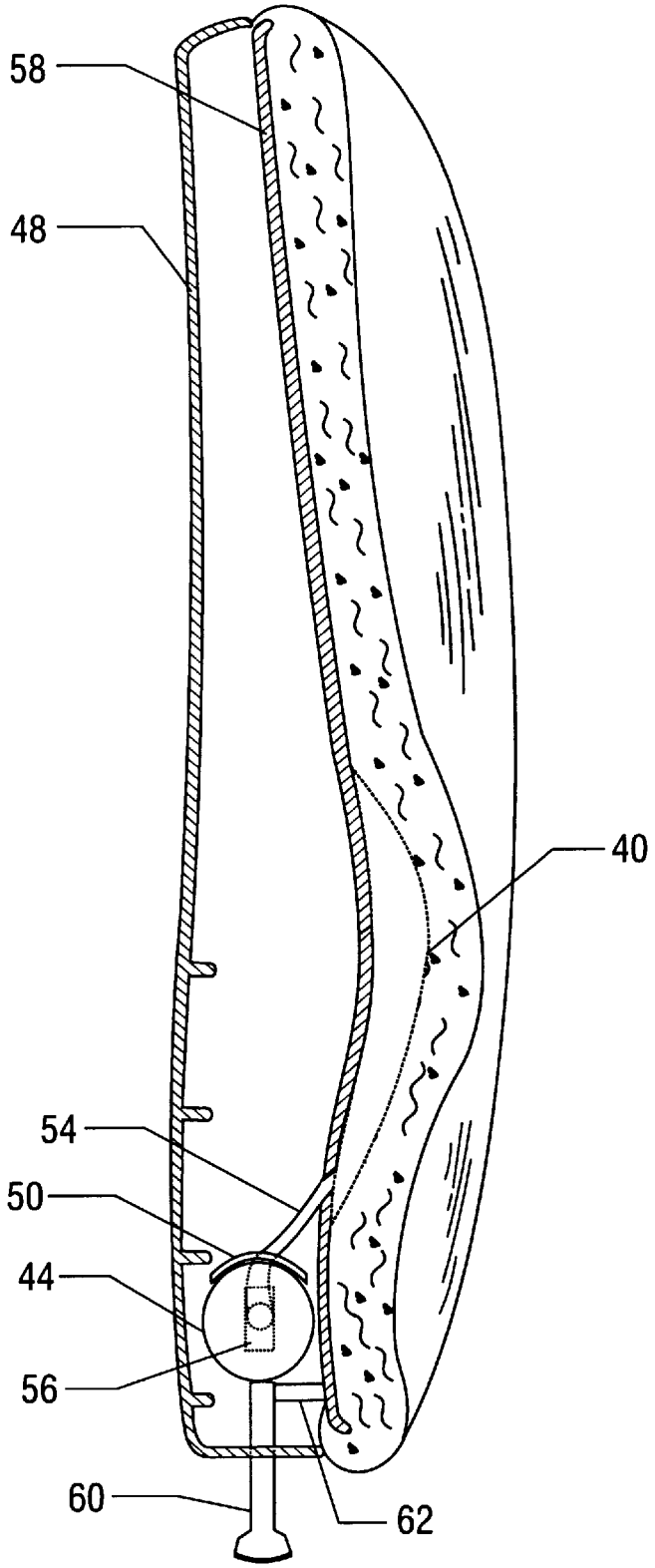

FIG. 4B shows the side view of FIG. 4A to further elaborate on this embodiment. Thus, the expandable fluid bladder 40 may be inflated or deflated with the same actuator 60.

Referring to FIG. 5, another embodiment of the present invention is shown. The operation is similar to the previous embodiments with the same advantages as the previous embodiments. Additional components have been added. Placed between actuator 60 and pump means 44 is buffer 64. Buffer 64 is pivotally mounted on the chair back. Buffer 64—preferably made from hard plastic and shaped to shield pump means 44—protects pump means 44—preferably a rubber bulb pump made from soft rubber—from excessive wear by actuator 60—also preferably made of hard plastic. Buffer 64 is attached to the chair back via contact 75 which is secured to the chair back by small pin 68.

To inflate expandable fluid bladder 40, the seated user applies an upward force to actuator 60 with her hand. Actuator 60 contacts buffer 64 which compresses pump means 44 against wall 50. Fluid, for example air, is forced through pump means 44, through valve means 56, through tubing 54, and finally into expandable fluid, or air, bladder 40. In this embodiment, a bulb pump is shown as the pump means.

To prevent actuator 60 from continually contacting fluid release 52—and thus deflating expandable fluid bladder 40—strategic posts and a clip 70 are used. First post 72 and second post 73 are located on the front plate and extend toward the actuator. Third post 74 is located on actuator 60. Clip 70 is connected as shown around first post 72, over second post 73, and against third post 74. In this way a upward force is constantly applied against third post 74. In this way a force counter clockwise about pin 62 is applied to actuator 60.

Pin 62 connects actuator 60 to the chair back. Clip 70, when wrapped around first post 72, second post 73, and third post 74, acts like a spring. In this way fluid release 52 is not continually depressed by actuator 60. Also, to keep valve means 56 in place, valve cover 66 is attached to the chair back by small pin 68.

To deflate expandable fluid bladder 40, the user applies a downward force on actuator 60. This downward force overcomes the force applied by clip 70. Actuator 60 pivots around pin 62 and depresses fluid release 52 on valve means 56. Once fluid release 52 is depressed, fluid flows from the expandable fluid bladder through tubing 54 and out valve means 56. The same actuator may be used by a person to inflate or deflate the air bladder as described above. Further, as shown, air is the fluid used; however, any fluid such as oil, water, air, or other gasses could be used.

FIG. 6A shows a side and top view of actuator 60. As shown, third post 74 protrudes from actuator 60. Further, actuator 60 has a wide handle on one end to allow the user to easily grasp the actuator.

FIG. 7 shows another embodiment of the present invention in which actuator 60 is placed on the side of the chair back. Thus, the current invention is not limited to having actuator located in any particular location on the chair back. Finally, shown in FIG. 8 is the prospective view of the prior art industrial chair with one embodiment of the invention shown. When user (not shown) sits on seat 12, her hand will easily reach the actuator 60 located at the rear of the chair back.

Although various embodiments have been shown and described, the invention is not so limited and will be understood to include all such modifications and variations as would be apparent to one skilled in the art.

What is claimed is:

1. A pump assembly in combination with a chair back having an expandable fluid bladder for lumbar support, said expandable fluid bladder being inflatable and deflatable by a person seated in a chair which includes as one component said chair back, comprising:

pump means in fluid communication with the expandable fluid bladder for transferring fluid into the expandable fluid bladder, said expandable fluid bladder being located in the chair back;

an actuator being located substantially adjacent the pump means, the actuator in intermittent contact with the pump means to engage the pump means to transfer fluid into said expandable fluid bladder;

valve means being located substantially adjacent the actuator, the valve means functionally adapted to release fluid from said expandable fluid bladder based on contact with said actuator, the valve means having a first end, a second end, and a fluid release, the first end of the valve means connected to the pump means;

tubing, the second end of the valve means connected to the expandable fluid bladder by the tubing, the actuator contacting the fluid release to release fluid from said expandable fluid bladder;

a biasing means adapted to resist the actuator's contacting the fluid release, the biasing means having a clip, the clip having a top side and a bottom side, the clip having a first end and a second end, the biasing means having a first post connected to the chair back, said first post contacting the top side of the first end of the clip the biasing means having a second post connected to the chair back, the second post contacting the bottom side of the clip at a location on the clip between the first end and the second end of the clip, and the biasing means having a third post located on the actuator, the third post contacting the top side of the second end of the clip, the clip being connected to each post to bias the actuator in a direction away from the valve means.

2. A pump assembly in combination with a chair back having an expandable fluid bladder for lumbar support, said expandable fluid bladder being inflatable and deflatable by a person seated in a chair which includes as one component said chair back, comprising:

pump means in fluid communication with the expandable fluid bladder for transferring fluid into the expandable fluid bladder, said expandable fluid bladder being located in the chair back;

an actuator being located substantially adjacent the pump means, the actuator in intermittent contact with the pump means to engage the pump means to transfer fluid into said expandable fluid bladder;

valve means being located substantially adjacent the actuator, the valve means functionally adapted to release fluid from said expandable fluid bladder based on contact with said actuator; and a buffer pivotally mounted on the chair back between the pump means and the actuator.

3. The pump assembly according to claim 2 further comprising a substantially rigid contact adapted to movably secure the buffer onto the chair back, the contact removably connected to the chair back, the buffer being located in an area between the chair back and the contact.

4. A pump assembly in combination with a chair back having an expandable fluid bladder for lumbar support, said expandable fluid bladder being inflatable and deflatable by a person seated in a chair which includes as one component said chair back, comprising:

pump means in fluid communication with the expandable fluid bladder for transferring fluid into the expandable fluid bladder, said expandable fluid bladder being located in the chair back;

an actuator being located substantially adjacent the pump means, the actuator in intermittent contact with the pump means to engage the pump means to transfer fluid into said expandable fluid bladder;

valve means being located substantially adjacent the actuator, the valve means functionally adapted to release fluid from said expandable fluid bladder based on contact with said actuator; and a valve means cover connected to the chair back by a screw, the valve means being positioned between the valve means cover and the chair back.

5. A pump assembly in combination with a chair back having an air bladder for lumbar support, said air bladder being inflatable and deflatable by a person seated in a chair which includes as one component said chair back, comprising:

pump means in fluid communication with the expandable fluid bladder for transferring air into the air bladder;

said air bladder being located in the chair back;

an actuator being located substantially adjacent the pump means, the actuator in intermittent contact with the pump means to engage the pump means to transfer air into said air bladder;

valve means being located substantially adjacent the actuator, the valve means functionally adapted to release air from said air bladder based on contact with said actuator;

tubing, the valve means further comprising a first end, a second end, and a fluid release, the first end of the valve means connected to the pump means, the second end of the valve means connected to the air bladder by tubing, the actuator contacting the fluid release to release fluid from said air bladder;

a buffer pivotally mounted on the chair back between the pump means and the actuator;

a substantially rigid contact adapted to movably secure the buffer onto the chair back, the contact removably connected to the chair back, the buffer being located in an area between the chair back and the contact;

a wall mounted on the chair back, the wall adjacent to the pump means;

a biasing means connected to the actuator adapted to resist the actuator contacting the valve means, the biasing having a clip, the clip having a top side and a bottom side, the clip having a first end and a second end, the biasing means having a first post connected to the chair back, the first post contacting the top side of the first end of the clip, the biasing means having a second post connected to the chair back, the second post contacting the bottom side of the clip at a location on the clip between the first end and the second end of the clip, and the biasing means having a third post located on the actuator, the third post contacting the top side of the second end of the clip, the clip being connected to each post to bias the actuator in a direction away from the valve means; and a valve means cover connected to the chair back by a screw, the valve means being positioned between the valve cover and the chair back.

6. A pump assembly for a use with a chair back having an expandable fluid bladder, the expandable fluid bladder being inflatable and deflatable by a person seated in a chair, comprising:

a pump;

a valve having a fluid release;

means, pivotally attached to the chair back, for engaging the pump to inflate the expandable fluid bladder;

means for contacting the fluid release on the valve to deflate the air bladder; and a buffer pivotally mounted on the chair back between pump and the means for engaging the pump.

7. The pump assembly according to claim 6 further comprising a substantially rigid contact adapted to movably secure the buffer onto the chair back, the contact being removably connected to the chair back, the buffer being located in an area between the chair back and the contact.

8. A pump assembly for a use with a chair back having an expandable fluid bladder, the expandable fluid bladder being inflatable and deflatable by a person seated in a chair, comprising:

a pump;

a valve having a fluid release;

means, pivotally attached to the chair back, for engaging the pump to inflate the expandable fluid bladder;

means for contacting the fluid release on the valve to deflate the air bladder; and a biasing means connected to the actuator adapted to resist the actuator contacting the fluid release, the biasing means having a clip, the clip having a top side and a bottom side, the clip having a first end and a second end the biasing means having a first post connected to the chair back, said first post contacting the top side of the first end of the clip the biasing means having a second post connected to the chair back, the second post contacting the bottom side of the clip at a location on the clip between the first end and the second end of the clip and the biasing means having a third post located on the actuator, the third post contacting the top side of the second end of the clip, the clip being connected to each post to bias the actuator in a direction away from the valve means.

9. A pump assembly for a use with a chair back having an expandable fluid bladder, the expandable fluid bladder being inflatable and deflatable by a person seated in a chair, comprising:

a pump;

a valve having a fluid release;

means, pivotally attached to the chair back, for engaging the pump to inflate the expandable fluid bladder; and means for contacting the fluid release on the valve to deflate the air bladder; and a valve cover connected to the chair back by a screw, the valve being positioned between the valve cover and chair back.

* * * * *